US006561555B1

(12) United States Patent
Millard

(10) Patent No.: US 6,561,555 B1
(45) Date of Patent: May 13, 2003

(54) MAGNETIC LOCK

(76) Inventor: Pieter Johannes Millard, 3 Vlet Str Glen Marais, Kempton Park (ZA)

( * ) Notice: Subject to any disclaimer, the term of this patent is extended or adjusted under 35 U.S.C. 154(b) by 0 days.

(21) Appl. No.: 10/111,951

(22) PCT Filed: Oct. 25, 2000

(86) PCT No.: PCT/IB00/01537

§ 371 (c)(1),
(2), (4) Date: Apr. 26, 2002

(87) PCT Pub. No.: WO01/31154

PCT Pub. Date: May 3, 2001

(30) Foreign Application Priority Data

Oct. 26, 1999 (ZA) ..... 99/6728

(51) Int. Cl.[7] ..... E05C 17/56
(52) U.S. Cl. ..... 292/251.5; 292/341.16
(58) Field of Search ..... 292/251.5, 340, 292/341.15, 341.16

(56) References Cited

U.S. PATENT DOCUMENTS

| | | | | | |
|---|---|---|---|---|---|
| 2,514,927 | A | | 7/1950 | Bernhard | 292/1 |
| 2,673,111 | A | | 3/1954 | Teetor | 292/251.5 |
| 2,719,050 | A | | 9/1955 | Teetor | 292/251.5 |
| 2,970,857 | A | | 2/1961 | Squire | 292/251.5 |
| 4,155,576 | A | * | 5/1979 | Kennon | 292/251.5 |
| 4,331,355 | A | * | 5/1982 | Okuno | 292/251.5 |
| 4,401,346 | A | * | 8/1983 | Jones | 292/144 |
| 4,487,439 | A | * | 12/1984 | Mcfadden | 292/251.5 |
| 6,007,119 | A | * | 12/1999 | Roth | 292/251.5 |

FOREIGN PATENT DOCUMENTS

| | | | |
|---|---|---|---|
| FR | 1.308.525 | 9/1962 | |
| WO | 99/18315 | 4/1999 | E05C/19/16 |

* cited by examiner

*Primary Examiner*—Gary Estremsky
(74) *Attorney, Agent, or Firm*—Davis & Bujold, P.L.L.C.

(57) ABSTRACT

A magnetic lock assembly is disclosed, the assembly including a locking component which has a lock housing and magnetic lock member, the magnetic lock member being housed in the lock housing and a striker component which has a striker plate which is magnetically attracted to the magnetic lock in a locking direction by a magnetic force produced by the magnetic lock member, in use. The assembly is characterized therein that the striker plate and the magnetic lock member are movable relative to each other in the locking direction, the striker plate and the magnetic lock member include complementary latching formations and the striker component and the locking component have cooperating displacing mechanism for displacing the striker plate and the magnetic lock member relative to each other in the locking direction upon movement of the striker plate and the magnetic lock member relative to each other in a transverse direction. The invention extends to a door including a magnetic lock assembly.

12 Claims, 4 Drawing Sheets

MAGNETIC LOCK

FIELD OF THE INVENTION

This invention relates to a lock assembly which is mountable in a door or gate and a frame of the door or gate. More particularly, this invention relates to a magnetic lock assembly which is mountable in the door or a gate and its associated frame. The invention extends to door (or gate) and frame including the lock.

SUMMARY OF THE INVENTION

According to a first aspect of the invention, there is provided a magnetic lock assembly which includes a locking component which has a lock housing and a magnetic lock member, the magnetic lock member being housed in the lock housing; and a striker component which has a striker plate which is magnetically attracted to the magnetic lock member in a locking direction by a magnetic force produced by the magnetic lock member, in use: characterised therein that the striker plate and the magnetic lock member are movable relative to each other in the locking direction;

the striker plate and the magnetic lock member include complementary latching formations; and the striker component and the locking component have co-operating displacing means for displacing the striker plate and the magnetic lock member relative to each other in the locking direction upon movement of the striker plate and the magnetic lock member relative to each other in a transverse direction.

The complementary latching formations may be in the form of a projecting latch formation and a complementary recess in which the latch formation is receivable.

It will thus be appreciated that, when the striker plate and the lock member are aligned, the projecting latch formation is received in the recess and, when the lock member is magnetically energised, and the striker plate is drawn towards and clamped against the lock member. The lock member and the striker plate are thus mechanically engaged by means of the latching formations and a shearing force necessary to force the two elements apart in a transverse direction is much greater than would be the case without the latching formations.

The lock member may be electromagnetically operable.

An urging means may be provided for urging the striker plate and the lock member towards one another in the locking direction.

The displacing means may be cam-like. Conveniently, a guide means may be provided which comprises at least one roller element and at least one profiled guide surface, the roller element being carried by the striker plate and the guide surface being provided on the lock member, or vice versa.

The guide surface may be wave shaped in profile. Conveniently, the or each guide surface may have a trough portion and a crest portion on either side thereof.

The projecting latch formation and the recess may be curved in profile to facilitate entry and exit of the projecting latch formation into and out of the recess as the striker plate and lock member move relative to each other in the transverse direction.

The striker component may have a striker housing in which the striker plate is located or a base plate on which it is mounted.

Further, the striker plate preferably includes the projecting latch formation and the lock member includes the recess.

Similarly, the striker component preferably includes the roller element and the locking component includes the guide surface. Preferably, the striker plate carries the roller element and the lock member includes the guide surface.

The lock housing may be locatable in the door frame and the striker component in the door.

According to a second aspect of the invention, there is provided a closure which includes a magnetic lock assembly as described above. The closure may be in the form of a door or a gate.

BRIEF DESCRIPTION OF THE DRAWINGS

The invention is now described, by way of example, with reference to the accompanying drawings in which.

DETAILED DESCRIPTION OF THE INVENTION

Figure 1:
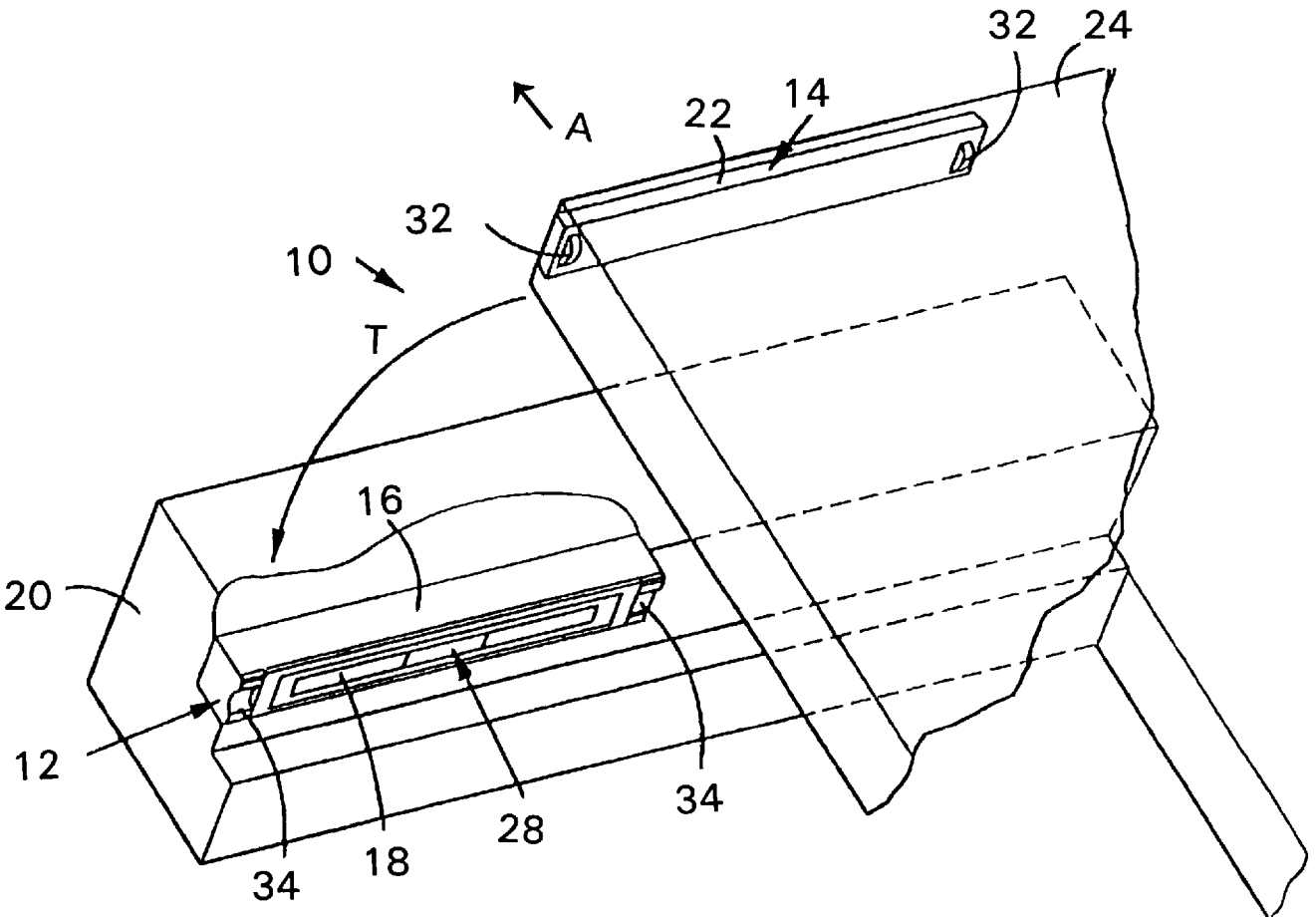
FIG. 1 shows a schematic, isometric view of a magnetic lock assembly according to the invention, with a locking component and a striker component being spaced apart.
Figure 2:
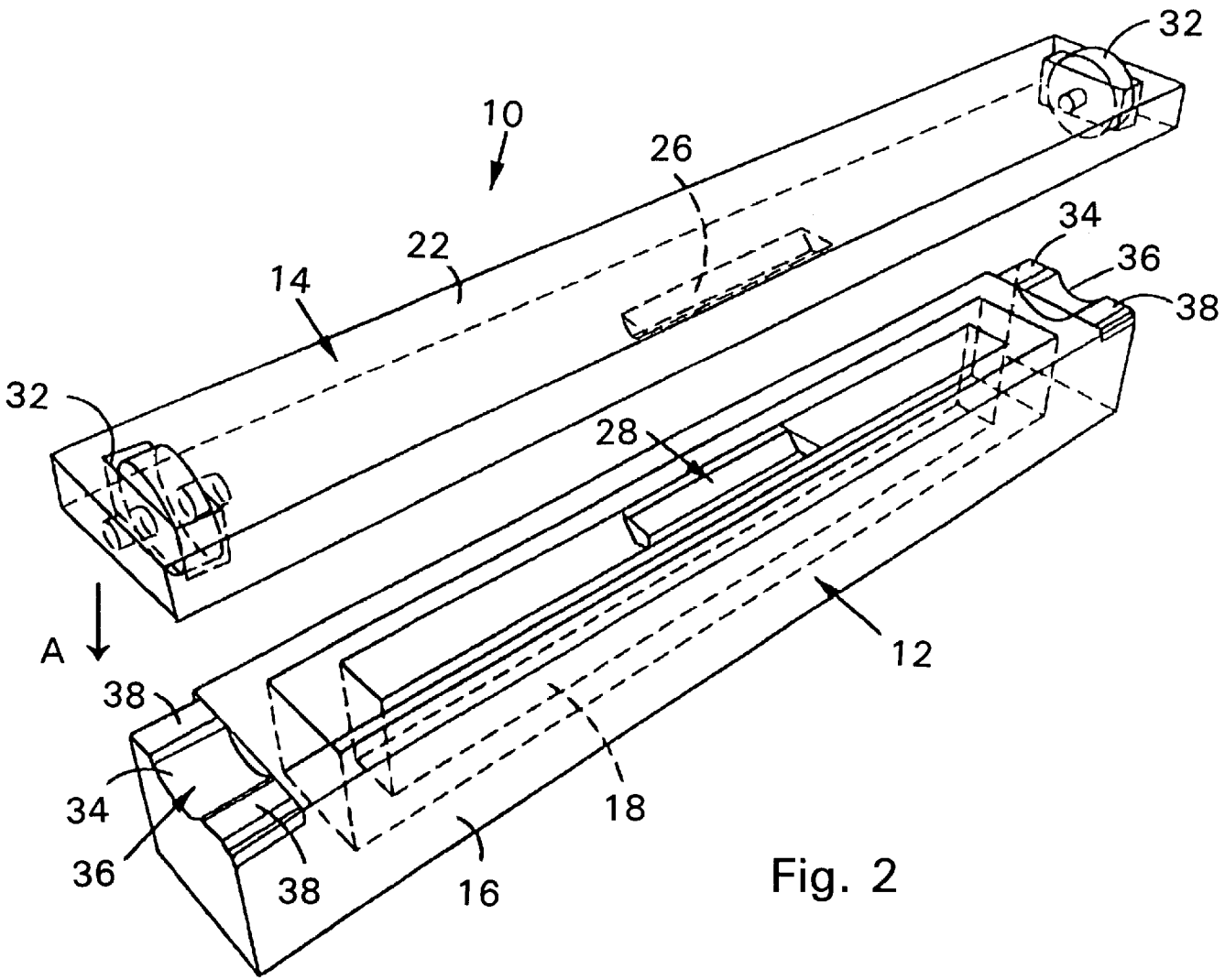
FIG. 2 shows an enlarged isometric view of the magnetic lock assembly of FIG. 1.

In FIGS. 1 and 2, a magnetic lock assembly according to the invention is generally referred to by reference numeral 10. A magnetic lock assembly 10 is shown to include a locking component 12 and a striker component 14.

The locking component 12 comprises a lock housing 16 and a magnetic lock member 18. The lock member 18 is housed in the lock housing 16 and is electromagnetically operable. The lock housing 16 is mountable in a door frame 20 as shown in FIG. 1.

The striker component 14 has a striker plate 22 which is magnetically attracted to the lock member 18 in a locking direction A as shown in FIGS. 1, 2 and 3(*d*), by a magnetic force provided by the lock member 18 and exerted on the striker plate 22 when they are aligned, in use. The striker component 14 is mountable in a door 24 as shown in FIG. 1.

The striker plate 22 has a projecting latch formation 26 and the lock member 18 has a complementary recess 28 into which the latch formation 26 is received when the striker plate 12 and the lock member 18 are aligned, in use, as shown in FIG. 3(*a*). When the lock member 18 is magnetically energised, and the striker plate 22 is clamped against the lock member 18, they are mechanically engaged by means of the projecting latch formation 26 and recess 28. It will be appreciated that a shearing force necessary to force the two apart in this situation is much greater than would be the case without the latch formation 26 and the recess 28.

The striker component 14 and the locking component 12 have co-operating displacement means 30, as specifically shown in FIGS. 3(*a*) and 3(*d*), for displacing the striker plate 22 and the lock member 18 towards and away from each other in the locking direction A, upon movement of the striker plate 22 and the lock member 18 towards and away from each other in a transverse direction T. The displacing means 30 comprises two rollers 32 and two profiled guide surfaces 34. The rollers 32 are carried by the striker plate 22 and the guide surfaces 34 are provided on the lock member 18.

The guide surfaces 34 are wave shaped and each has a trough portion 36 and a crest portion 38 on either side of the trough portion 36.

The projecting latch formation 26 and the recess 28 are curved to facilitate entry and exit of the latch formation 26 into and out of the recess 28 as the striker plate 22 and lock member 1 8 move relative to one another in the transverse direction T.

Figure 4:
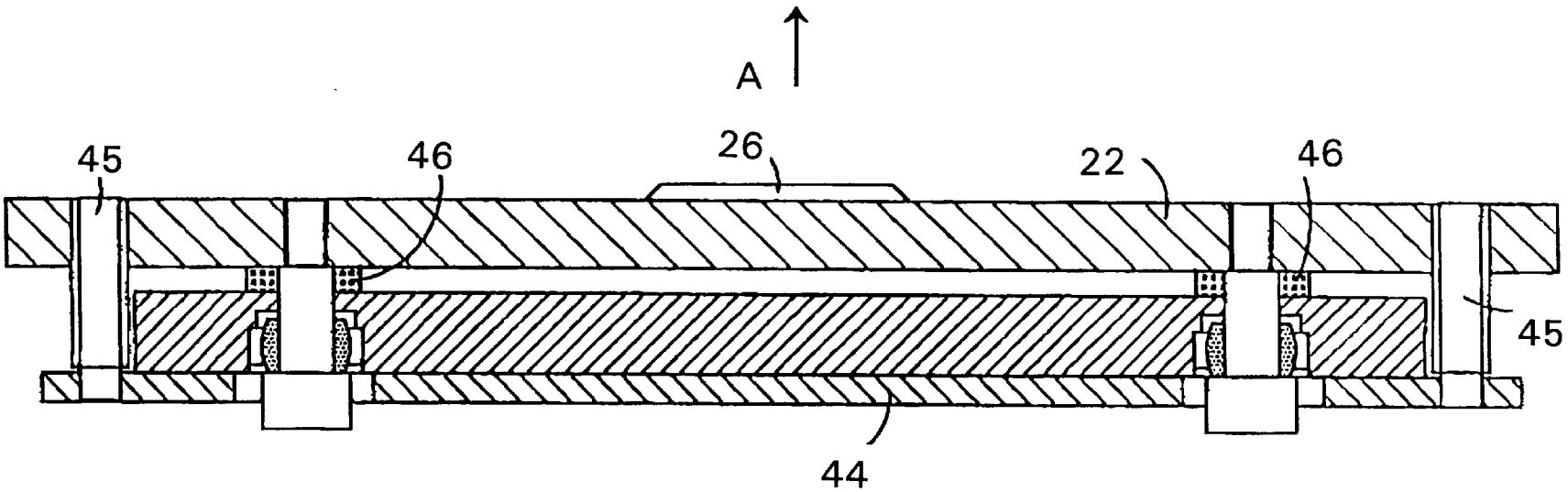
FIG. 4 shows a sectioned side view of the striker component.

The striker component 14 includes a base plate 44, as seen in FIG. 4, on which the striker plate 22 is mounted with mounting pins 45. A pair of urging means, each in the form of a helical coil spring 46 is provided for urging the striker plate 18 towards the locking component 12 in the locking direction A.

Figure 3C:
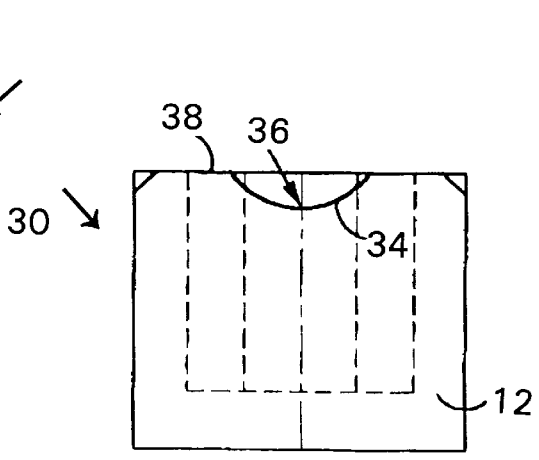
FIG. 3*c* shows a schematic side view of the locking component of the lock assembly.
Figure 3B:
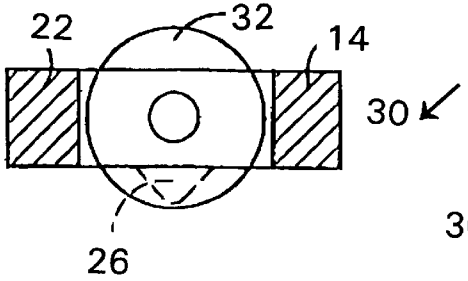
FIG. 3*b* shows a schematic side view of the striker component of the lock assembly.
Figure 3A:
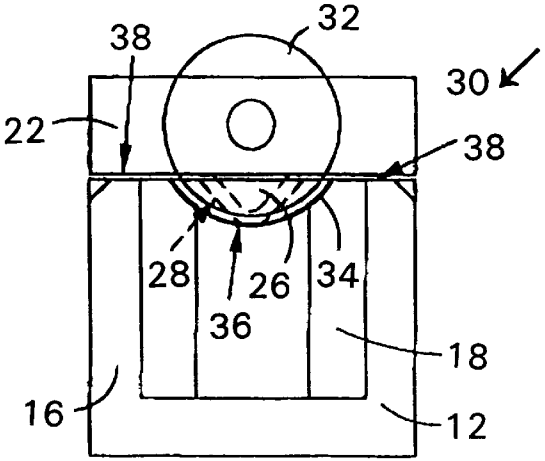
FIG. 3*a* shows a schematic side view of the lock assembly of FIG. 1.
Figure 3D:
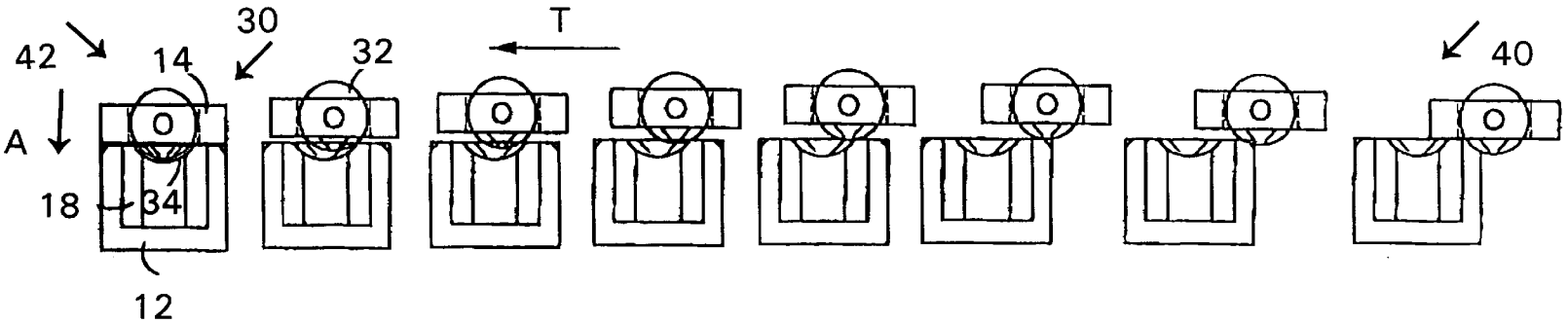
FIG. 3*d* illustrates the relative movement between the striker component and the locking component.

In use, as specifically illustrated in FIGS. 1 and 3*d* of the drawings, when the door 24 is moved in the direction T, transverse to the locking direction A, towards the door frame 20, the striker plate 22 of the striker component 14 approaches the guide surfaces 34 of the locking component 12 from position 40 as illustrated in FIG. 3*d*. The striker plate 22 moves in direction T until it reaches the locked position as illustrated by position 42 in FIG. 3*d*. As the striker plate 22 moves towards position 40, in use, the rolling elements 32 make contact with the wave shaped guide surfaces 34 on the lock member 18. As the striker plate 22 is moved along direction T towards position 42, the rolling elements 32 move over the crest portions 38 of the guide surfaces 34 and lift the striker plate 22 from the surface of the lock member 18 under tension of the coil springs 46. This action, in turn, lifts the projecting latch formation 26 on the striker plate 22 clear of the surface of lock member 18. As the striker plate 22 moves to position 42, the rolling elements 32 move downwards into the trough portions 36 of the guide surfaces 34. This action leads to the projecting latch formation 26 settling snugly in the recess 28.

At this stage, the rolling elements 32 do not make contact with the guide surfaces 34, the lock member 18 is not providing a magnetic force as it is not energised yet, and the urging means 46 is urging the striker plate 22 to make contact with the surface of the lock member 18. A sensor (not shown) detects the proximity of the striker plate 22 and after a short delay, a magnetic force is produced by the lock member 18 and the striker plate 22 is attracted to the surface of the lock member 18 by magnetic attraction.

The projecting latch formation 26 of the striker plate 22 is now locked into the recess 28 of the lock member 18 by the magnetic attraction.

When the magnetic force is removed, only the urging means 46 urges the striker plate 22 onto the surface of the lock member 18 and a slight force is necessary to move the latch formation 26 out of the recess 28, thus allowing the door 24 to open easily.

The Applicant believes that the invention has several advantages. The most important advantage is that the displacement means provides a way of alleviating problems experienced with accurate alignment the latch formation with the striker plate before the magnet is energised.

What is claimed is:

1. A magnetic lock assembly (10) including:

a locking component (12) which has a lock housing (16) and a electromagnetically operable lock member (18), the lock member being housed in the lock housing;

a striker component (14) which has a striker plate (22) which is magnetically attracted to the lock member in a locking direction by a magnetic force produced by the lock member, the striker plate and the lock member being movable relative to each other in the locking direction;

complementary latching formations (26, 28) provided on the striker plate and the lock member, wherein;

the striker component and the locking component have cooperating displacing means (30) for displacing, in use, the striker plate and the lock member relative to each other in the locking direction upon movement of the striker plate and the lock member relative to each other in a transverse direction, the displacing means including a guide means comprising a rolling element (32) and a profiled guide surface (34), one being located on the striker plate and the other on the lock member.

2. The assembly according to claim 1, wherein the complementary latching formations are in the form of a projecting latch formation (26) and a complementary recess (28) in which the latch formation is receivable.

3. The assembly according to claim 1, wherein the assembly includes an urging means (46) for urging the striker plate and the lock member towards each other in the locking direction.

4. The assembly according to claim 1, wherein the assembly includes a pair of spaced rolling elements and guide surfaces.

5. The assembly according to claim 4, wherein each guide surface is wave shaped in profile.

6. The assembly according to claim 5, wherein each guide surface has a trough portion (36) and a crest portion (38) on either side thereof.

7. The assembly according to claim 2, wherein the projecting latch formation and the recess are curved in profile to facilitate entry and exit of the projecting latch formation into and out of the recess as the striker plate and lock member move relative to each other in the transverse direction.

8. The assembly according to claim 1, wherein the striker component includes a base plate (44) on which the striker plate is mounted.

9. The assembly according to claim 2, wherein the striker plate carries the projecting formation and the lock member has the recess.

10. The assembly according to claim 1, wherein the striker component carries the rolling element and the locking component has the guide surface.

11. The assembly according to claim 1, wherein the locking component is mountable to a door frame (20) and the striker component is mountable to a door (24).

12. A door assembly comprising a door and frame, wherein the asssembly includes a magnetic lock assembly, and the magnetic lock assembly (10) including:

a locking component (12) which has a lock housing (16) and a electromagnetically operable lock member (18), the lock member being housed in the lock housing;

a striker component (14) which has a striker plate (22) which is magnetically attracted to the lock member in a locking direction by a magnetic force produced by the lock member, the striker plate and the lock member being movable relative to each other in the locking direction;

complementary latching formations (26, 28) provided on the striker plate and the lock member, wherein;

the striker component and the locking component have cooperating displacing means (30) for displacing, in use, the striker plate and the lock member relative to each other in the locking direction upon movement of the striker plate and the lock member relative to each other in a transverse direction, the displacing means including a guide means comprising a rolling element (32) and a profiled guide surface (34), one being located on the striker plate and the other on the lock member.

* * * * *

UNITED STATES PATENT AND TRADEMARK OFFICE

CERTIFICATE OF CORRECTION

PATENT NO. : 6,561,555 B2 
DATED : March 11, 2003
INVENTOR(S) : Whiteker

It is certified that error appears in the above-identified patent and that said Letters Patent is hereby corrected as shown below:

Title page,
Item [73], Assignee, "Univation Technologies, LLP, Houston, Texas (US)" should be deleted and -- Univation Technologies, LLC, Houston, Texas (US) -- inserted therefore.
Item [57], ABSTRACT, the formula

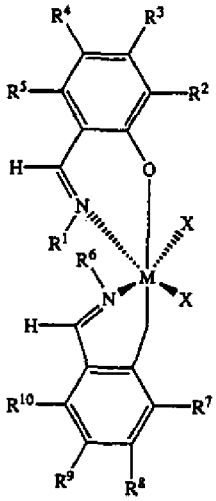

should be deleted, and

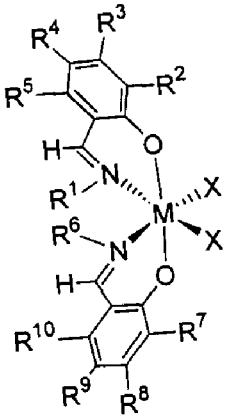

inserted therefore.

Signed and Sealed this

Fourth Day of January, 2005

JON W. DUDAS
*Director of the United States Patent and Trademark Office*

UNITED STATES PATENT AND TRADEMARK OFFICE

CERTIFICATE OF CORRECTION

PATENT NO. : 6,561,555 B1
DATED : May 13, 2003
INVENTOR(S) : Pieter Johannes Millard It is certified that error appears in the above-identified patent and that said Letters Patent is hereby corrected as shown below:

This certificate supersedes certificate of correction issued January 4, 2005, the number was erroneously mentioned and should be vacated since no certificate of correction was granted.

Signed and Sealed this

Twenty-ninth Day of March, 2005

JON W. DUDAS
*Director of the United States Patent and Trademark Office*